US007758088B2

(12) United States Patent
Hapke

(10) Patent No.: US 7,758,088 B2
(45) Date of Patent: Jul. 20, 2010

(54) VENDING MACHINE LOCK SYSTEM

(75) Inventor: Kenyon A. Hapke, Libertyville, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 12/372,482

(22) Filed: Feb. 17, 2009

(65) Prior Publication Data

US 2009/0151410 A1 Jun. 18, 2009

Related U.S. Application Data

(63) Continuation of application No. 11/519,505, filed on Sep. 12, 2006, now abandoned.

(51) Int. Cl.
*E05C 3/06* (2006.01)
*E05C 19/00* (2006.01)

(52) U.S. Cl. ..... 292/201; 292/11; 292/44; 292/54; 292/101; 292/108; 292/304; 292/DIG. 11; 292/DIG. 68; 49/280

(58) Field of Classification Search ..... 292/201
See application file for complete search history.

(56) References Cited

U.S. PATENT DOCUMENTS

| | | | |
|---|---|---|---|
| 5,269,586 | A | 12/1993 | Hahn et al. |
| 5,575,515 | A | 11/1996 | Iwato et al. |
| 5,595,407 | A | 1/1997 | ter Horst et al. |
| 5,813,257 | A | 9/1998 | Claghorn et al. |
| 6,877,346 | B1 | 4/2005 | Finkelstein |

FOREIGN PATENT DOCUMENTS

| | | |
|---|---|---|
| JP | 03-266096 | 11/1991 |

OTHER PUBLICATIONS

Lugo, Carlos, PCT International Search Report, dated Feb. 25, 2009, ISA/US, Alexandria, Virginia, USA.

*Primary Examiner*—Carlos Lugo
(74) *Attorney, Agent, or Firm*—Boyle Fredrickson, S.C.

(57) ABSTRACT

A motorized lock for a vending machine provides a simple lever mechanism that provides two separate points of engagement between the door and the machine to resist tampering and provide for more even pull in of a gasketed door.

22 Claims, 6 Drawing Sheets

FIG. 6
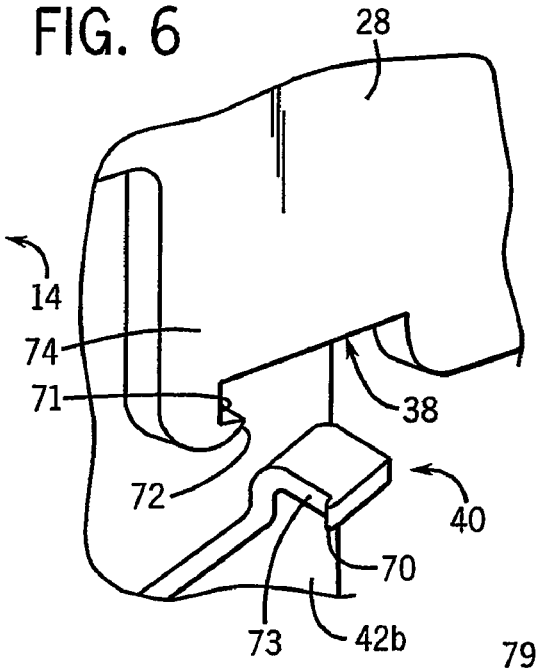
FIG. 7
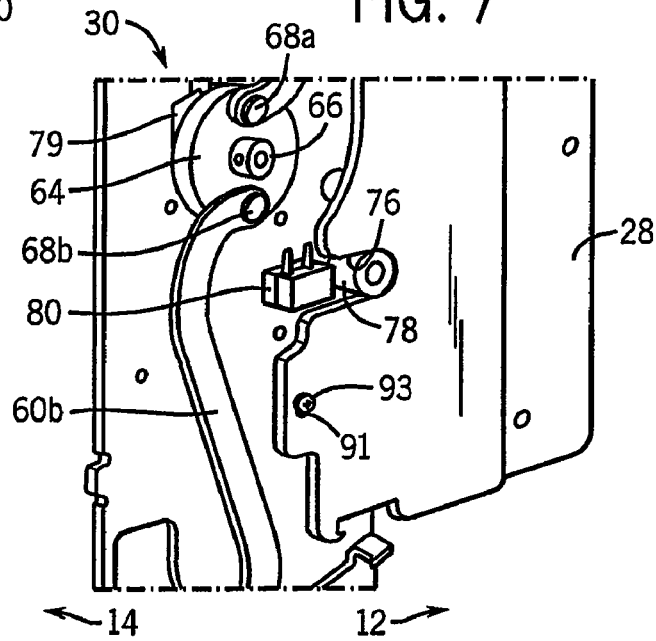
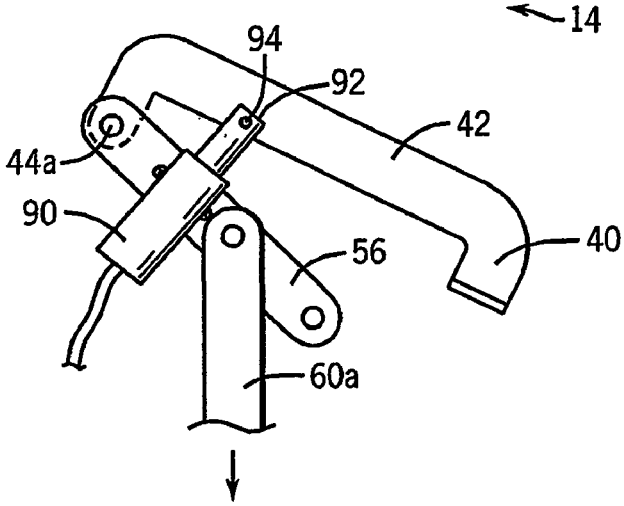
FIG. 9

VENDING MACHINE LOCK SYSTEM

CROSS-REFERENCE TO RELATED APPLICATIONS

This application is a continuation of U.S. application Ser. No. 11/519,505 filed Sep. 12, 2006 now abandoned thereby incorporated by reference.

STATEMENT REGARDING FEDERALLY SPONSORED RESEARCH OR DEVELOPMENT

--

BACKGROUND OF THE INVENTION

The present invention relates to vending machines and in particular to a motorized lock assembly for such vending machines.

Vending machines, such as may automatically dispense products to consumers, may provide a cabinet for holding the products to be dispensed and money handling machinery. The cabinet is normally covered by a lockable door that may, for example, extend over the entire front face of the vending machine, and which may seal the interior of the cabinet from the environment, often by means of a large flexible gasket extending around the perimeter of the door.

The lock of the vending machine door must both hold the door securely and provide for compression of the gasket to fully close the door. A common lock suitable for this purpose provides a pop-out T-handle that may be rotated to compress the gasket by drawing the handle in along a threaded shaft, and then pressed into a recess where the T-handle is prevented from further rotation and retained by a lock cylinder. Examples of such a lock are shown in U.S. Pat. No. 3,550,412, issued Dec. 29, 1970.

The time required to compress the gasket using a T-handle system (and conversely, to release the door by uncompressing the gasket) increases the time and cost of routine service of the vending machine, for example, to replenish stock and collect money. For this reason, motorized locks have been developed that may be triggered by a radio signal to begin unlocking the vending machine as a service person prepares for restocking, and that may automatically compress the gasket and lock the vending machine when restocking is complete as the service person completes other tasks. U.S. Pat. No. 6,581,986 describes a radio-controlled, motorized lock for vending machines that employs a bayonet that enters a slot and rotates to hold itself within the slot and then to pull the door closed, much like a T-handle system.

Improved security and a more uniform compression of the door gasket could be obtained through multiple locks joining the door and the cabinet. A single radio signal could coordinate these multiple locks, however, current motorized designs are prohibitively expensive.

SUMMARY OF THE INVENTION

The present invention provides a multi-point lock providing the increased security of two separate latch points, and a more uniform compression of the door gasket using a simple lever mechanism. The lever mechanism produces a hooking and pulling action that provides a large latch-throw suitable for gasketed doors, and provides high, end-stroke compression of the gasket to seal the gasket and resist unauthorized opening of the door.

Specifically, in a first embodiment of the present invention, a motorized vending machine lock is provided having a strike plate attached to one of a door and cabinet of the vending machine, and at least two bolts attached to an other of the door and cabinet. A single electric motor drives an actuation mechanism that, in the first operating mode, engages the bolts and strikes at spatially separated points and then draws the door against the cabinet, and in a second operating mode, releases the door from the cabinet and disengages the bolts from the strike plate.

Thus, it is one object of at least one embodiment of the invention to provide a cost-effective, multi-point latch using a single motor drive.

The spatially separated points of attachment of the bolts may be along the gasket at the edge of the door.

Thus, it is another object of at least one embodiment of the invention to provide improved stability in the closing of the door that reduces the need for additional door structure to manage door warping.

The actuator mechanism may operate in the first mode when the motor turns in a first direction, and in the second mode when the motor turns in a second direction.

Thus, it is another object of at least one embodiment of the invention to provide a simple two-mode locking and unlocking mechanism that requires only motor reversal to control.

The bolts may be pivoting hooks, having hook ends movable within a plane to engage and disengage with corresponding hook engagement points on the strike plate, and movable within the plane to extend and retract along a direction of separation of the door and cabinet.

Thus, it is another object of at least one embodiment of the invention to provide a simple lever mechanism that may be readily manufactured without the need for customized cam, screw, and gear elements.

The actuator mechanism may include a frame supporting the motor and a first and second swing arm. The first and second swing arms are pivotally attached to the frame at first ends and at second ends pivotally attached to a first pivot point on a corresponding first and second hook at a location on the hook removed from a hook portion engaging the strike plate. This attachment allows the swing arms and hooks to pivot with respect to each other through a range of acute angles. A crank may be attached to the motor providing a first and second crank end moving with actuation of the motor with a first and second drive linkage pivotally attached to corresponding crank ends and pivotally attached to second pivot points on the corresponding first and second hooks between the first pivot point and the hook portion.

Thus, it is an object of at least one embodiment of the invention to provide a locking mechanism that may work predominantly with pivoting linkages that are reliable, easy to manufacture, and compact to move within a single plane.

The swing arms may be substantially aligned in the direction of the separation of the door and cabinet when the hooks are engaged with the strike plate and the door is closed.

It is thus another object of at least one embodiment of the invention to provide an extremely high resistance to opening the door when the lock is closed resulting from the fact that forces of opening the door extend along the linkage aligned with that direction. This alignment compresses the swing arms against their pivot points rather than moves the swing arms against their drive linkages.

The hooks may engage and disengage from the hook engagement points by motion of the swing arms about pivot points substantially aligned with the corresponding hook engagement points along the direction of separation of the door and cabinet.

It is thus another object of at least one embodiment of the invention to provide extremely high leverage at the final stage of closure of the door, as the swing arms pivot into alignment with the closure axis, to offset the increasing force of resistance of a gasket.

The crank ends may be at substantially a 180 degree spacing about an axis of rotation of the crank, and the first and second drive linkages may extend symmetrically in opposite directions.

It is thus another object of at least one embodiment of the invention to provide a door closure system that exerts little or no side thrust on the motor.

The lock may include a radio link providing a signal to the motor to operate the motor in a first operating mode.

It is thus another object of at least one embodiment of the invention to provide a secure lock that greatly simplifies the stocking of a vending machine.

The invention may include an alignment guide positioning the strike plate and bolts in alignment before engagement of the bolts with the strike plate.

It is thus another object of at least one embodiment of the invention to accommodate possible door misalignment by correcting for that alignment during the closing process.

The invention may include a secondary lock holding the door closed for shipping.

It is thus another object of at least one embodiment of the invention to provide additional robustness during the shipping process when the cabinet may be subject to higher and/or different forces.

The lock may include an electric switch providing a signal indicating that the door is close enough to the cabinet for the bolts to engage the strike plate.

It is thus another object of at least one embodiment of the invention to allow the door to prevent misleading actuation of the lock when locking cannot occur.

These particular objects and advantages may apply to only some embodiments falling within the claims, and thus do not define the scope of the invention.

BRIEF DESCRIPTION OF THE FIGURES

FIG. 6 is a detailed view of FIG. 5 showing interengagement of the hook portion of the hook bolts and the strike engagement surface such as provides a highly secure interlock between the two;

FIG. 7 is a detailed view of FIG. 5 showing a door switch detecting proximity of the strike plate and lock assembly and an alignment guide bringing the strike plate and lock assembly into alignment prior to locking;

FIG. 9 is a figure similar to that of FIG. 4*a* of an alternative embodiment in which secondary electrical actuators such as solenoids are used to engage the hook bolts with the strike plate.

DETAILED DESCRIPTION OF THE PREFERRED EMBODIMENT

Figure 1:
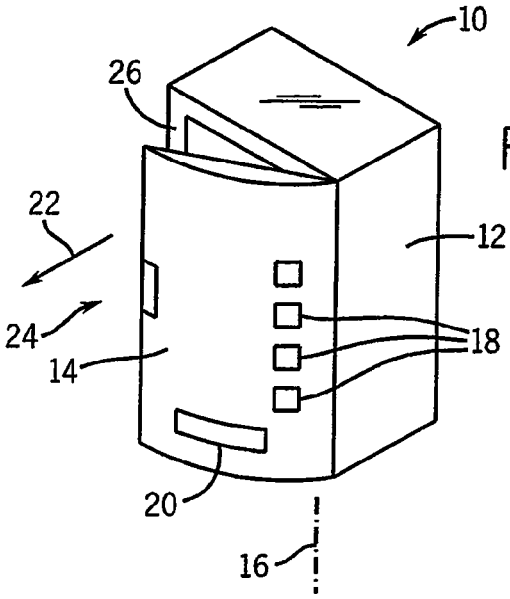
FIG. 1 is a perspective view of a typical vending machine cabinet showing a hinged door and location of the locking mechanism of the present invention.

Referring now to FIG. 1, a vending machine 10 suitable for use with the present invention may include a cabinet 12, being generally a metal box sized to hold a vending apparatus (not shown), and having an open front that may be covered by a door 14. The door 14 may display on its front surface vending controls 18, including product selection buttons and money handling apparatus, and may include a dispensing slot 20.

The door 14 may hinge about an axis 16, being in this example, a vertical axis aligned with a right side of the open face of the cabinet 12, to move between a closed position covering the opening of the cabinet 12, and an open position providing access to the interior of the cabinet 12. A compressible gasket 26 may be attached to the periphery of the open face of the cabinet 12 or the corresponding surface of the door 14 to seal the door 14 against the cabinet 12 when the door 14 is closed.

During the initial stages of opening the door 17 and the latter stages of closing the door 14, the edge of the door 14 removed from axis 16, moves generally along a separation axis 22 tangent to the arc of motion of the left edge of the door 14. The left edge of the door 14 may support a locking mechanism 24 as will now be described.

Figure 5:
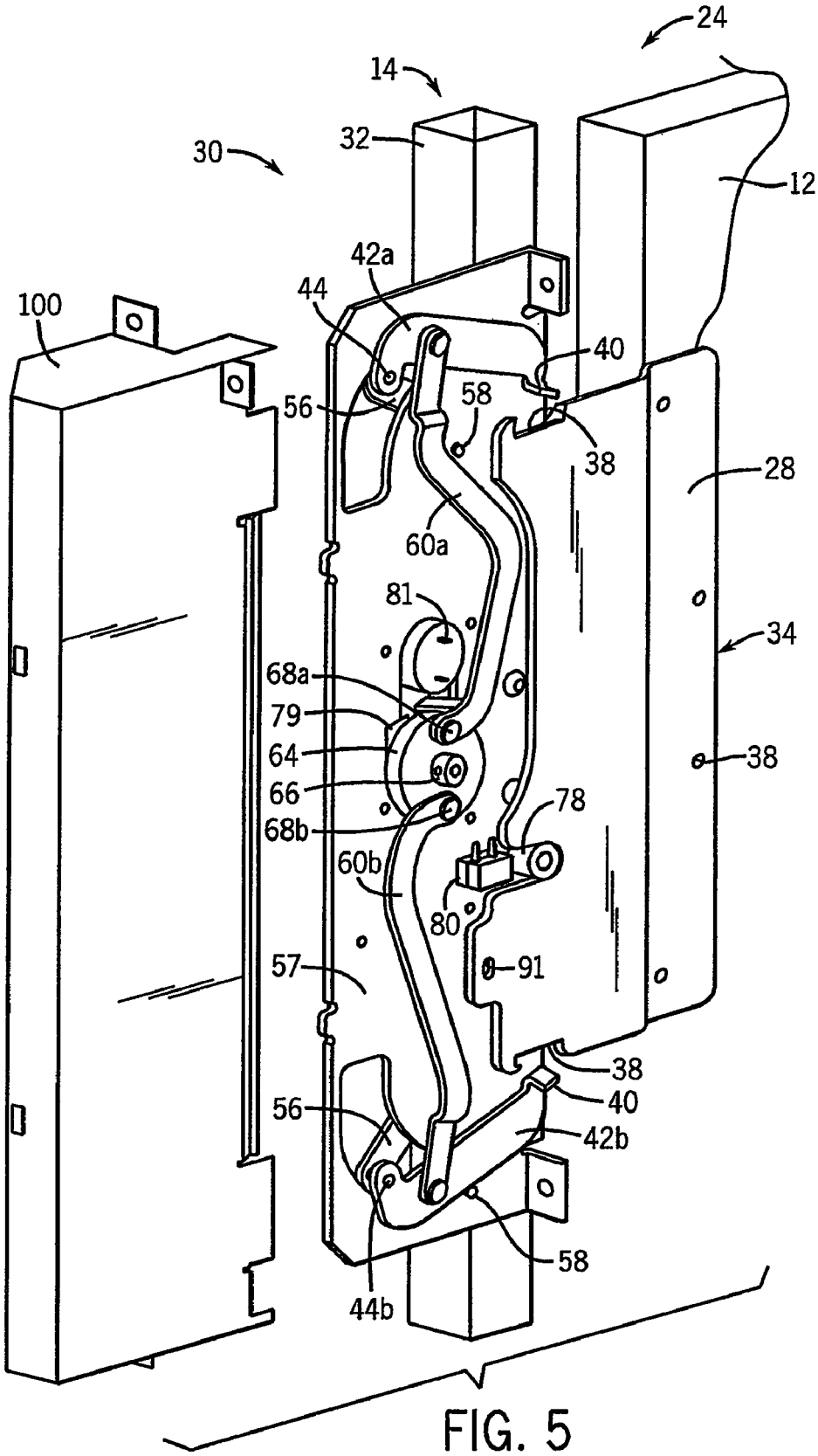
FIG. 5 is an exploded perspective view of the hook bolts and actuation arms as attached to a crank arm of a gear motor that may actuate both opposed hook bolts.

Referring momentarily to FIG. 5, the locking mechanism 24 of the present invention provides two different interengaging components, a strike plate 28 and a lock assembly 30, mounted on opposite sides of the door 14 and cabinet 12, respectively, so as to latch and unlatch the door 14 to the cabinet 12. The strike plate 28, mounted in this example on the cabinet 12, provides a vertical mounting edge 34 incorporating a series of mounting holes 36, allowing the strike plate 28 to be attached with one side affixed to the frame of the cabinet 12 to extend in a vertical plane aligned with the separation axis 22 along of the left edge of the cabinet 12.

Correspondingly, the lock assembly 30 may be attached to a rail 32 forming an outer peripheral frame of the door 14 to be positioned opposite the strike plate 28 along the separation axis 22.

Figure 2:
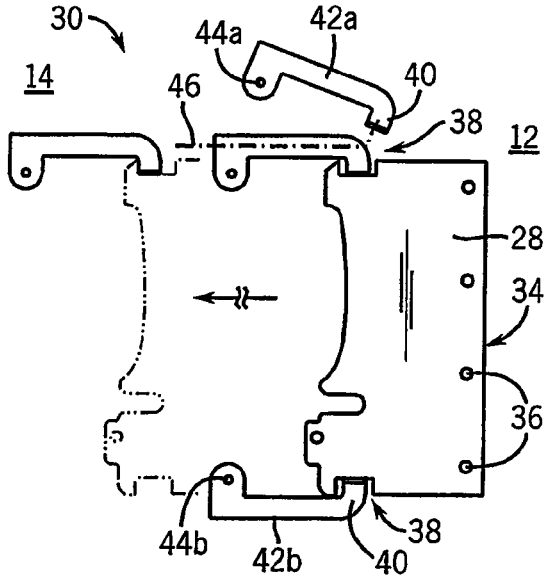
FIG. 2 is an exaggerated view of motion of the hook bolts of the present invention as they engage a strike plate for drawing the door into closure.

Referring now to FIG. 2, a top and bottom edge of the strike plate 28 provide vertically extending strike engagement notches 38 that may be engaged by a hook end 40 of upper and lower hook arms 42*a* and 42*b*, respectively, of the lock assembly 30. The hook arms 42*a* and 42*b* include pivot points 44*a* and 44*b* opposite the hook ends 40, allowing the hook arms 42*a* and 42*b* to swing in a vertical plane aligned with the plane of the strike plate 28 so that the hook ends 40 may engage with the strike engagement notches 38 when the hook ends 40 of the hook arms 42*a* and 42*b* swing toward each clamping the strike plate 28 therebetween and so that the hook ends 40 may disengage with the strike engagement notches 38 when the hook ends 40 of the hook arms 42*a* and 42*b* swing away from each releasing the strike plate 28.

Figure 3A:
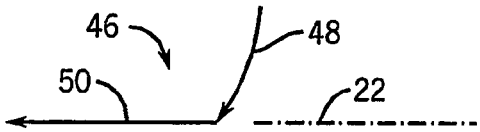
FIGS. 3*a* and 3*b* are diagrams of paths of the hook ends of the hook bolts of FIG. 2 during closure and release of the door, respectively.
Figure 3B:
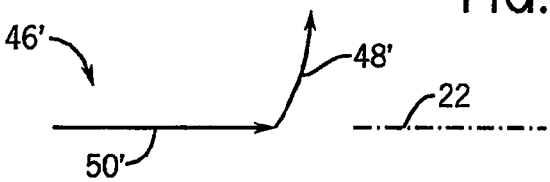

Referring to FIGS. 2 and 3, depending on an operating mode of locking or unlocking, the hook ends 40 follow a trajectory 46 or 46', each comprised of two stages of cross-axial motion 48 or 48' and axial motion 50 and 50' in which the hook ends 40 move generally within the plane of the strike plate 28, either across the separation axis 22 or along the separation axis 22.

When the door 14 is open, the disengaged hook ends 40 first have engaging cross-axial motion 48 in which they pivot toward each other so that the hook ends 40 engage the corresponding notches 38. The hook ends 40 are then retracted with a generally horizontal inward axial motion 50, drawing the strike plate 28 attached to the cabinet 12 toward the door 14.

When the door 14 is closed, the direction of these two motions and their order are reversed, with axial motion 50' (being the opposite of axial motion 50) allow separation of the strike plate and door 14 and cross-axial motion 48' (being the opposite of cross-axial motion 48) allowing the hook ends 40 to be released from their respective notches 38.

Figure 4A:
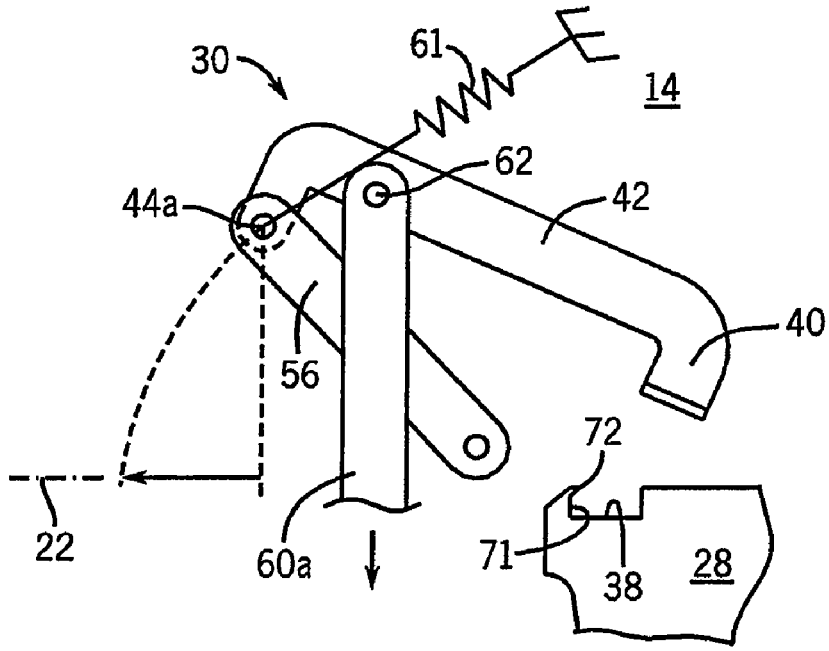
FIGS. 4*a* and 4*b* are elevational views of the hook bolts, swing arms, and actuation arms immediately prior to engagement of the hook bolts with the strike plate and at closure, respectively, showing the high-force amplification obtained and high resistance to opening of the door provided by the locking mechanism of the present invention.
Figure 4B:
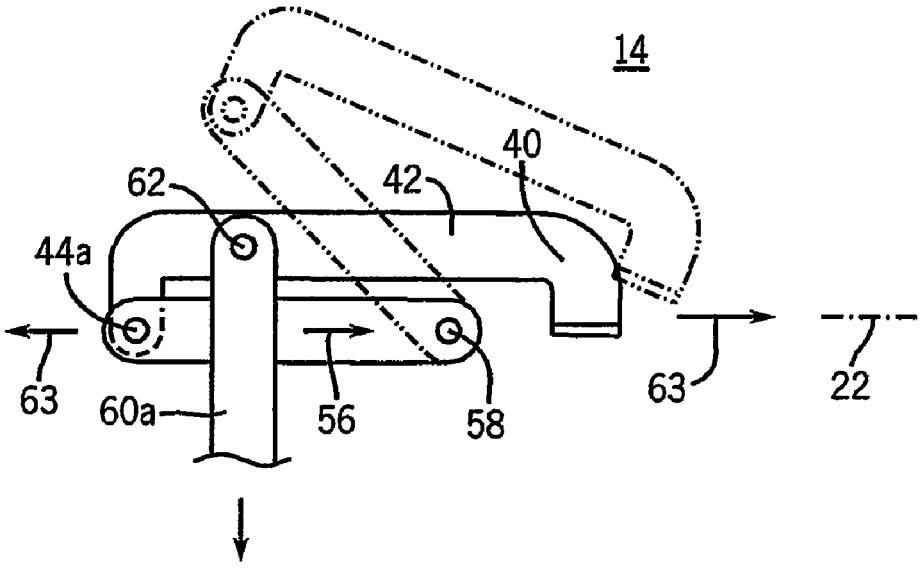

Because hook arms 42*a* and 42*b* move in mirror image trajectories reflected about a horizontal axis, the mechanism associated with hook arm 42*a* alone will be described, with the mechanism and operation of hook arm 42*b* simply understood as a mirror image of hook arm 42*a*. Referring then to FIGS. 4*a* and 4*b*, hook arm 42 is pivotally attached at pivot point 44*a* to a first end of a swing arm 56 to extend rightward therefrom so that during operation, hook arm 42 may pivot with respect to swing arm 56 about a range of acute angles with hook arm 42*a* above swing arm 56.

The remaining end of swing arm 56 is attached at pivot point 58 to a point on a support plate 57 generally parallel with the strike plate 28, but fixed with respect to the door 14. A spring 61 is attached to pivot point 44*a* and to a point fixed with respect to the door 14 so as to bias the swing arm 56 in a clockwise direction throughout a range of angles from about 45 degrees clockwise rotation above horizontal (as shown in FIG. 4*a*) to horizontal (as shown in FIG. 4*b*).

A drive arm 60*a* is pivotally attached to a pivot point 62 positioned between pivot point 44*a* and hook end 40, and may move vertically so as to effect the pulling and hooking and pushing and unhooking motions described with respect to FIGS. 2 and 3.

Referring specifically to FIG. 4*a*, when the door 14 is open, the hook end 40 is at the end of the cross-axial motion 48 prior to engaging notch 38 and drive arm 60*a* is in its full upward position. The downward motion of drive arm 60*a* causes hook arm 42 to swing in a clockwise direction in preference to movement of swing arm 56, the latter being biased by spring 61. Motion of hook arm 42 continues until hook end 40 engages the notch 38. At this point in time, further motion of the hook arm 42 is blocked, and downward motion of drive arm 60*a* is accommodated by rotation of swing arm 56 against the biasing of spring 61. This rotation of the swing arm 56 draws the hook end 40 in axial motion 50 until it engages with notch 71 and brings the strike plate along with it.

Referring to FIG. 9, in an alternative embodiment, the drive arm 60*a* may be pivotally attached to the swing arm 56 and an electrical actuator 90, such as a solenoid, may connect to the swing arm 56 and provide an actuator arm 94, pivotally attaching to the hook arm 42 to pull the hook arm 42 in the clockwise direction for engagement with the strike plate 28 and to push the hook arm 42 in the counterclockwise direction to disengage the hook arm 42 with the strike plate 28. The electrical actuator 90 may be driven by a set of contacts (not shown) associated with the gear motor 81 described below.

As will be understood from this description, in either embodiment, horizontal motion of the hook end 40 will be a function of a cosine of the angle of swing arm 56 with respect to the separation axis 22 of door 14. As a result, equal increments of downward motion of drive arm 60 provide decreasing pull-in motion of the hook end 40, with a concomitant increase in the force of the pull-in, increasing the leverage as the gasket is compressed and increased compression forces are required.

It will be further noted that when the lock is fully closed, forces 63 tending to separate the door and cabinet along the separation axis 22 are realized almost entirely in compression along the swing arm 56 rather than torque about pivot point 58, thus eliminating significant forces on drive arm 60*a* and its actuation mechanism to be described below.

Referring specifically to FIG. 4*b*, when the door 14 is closed and locked, the swing arm 56 is substantially horizontal and the hook end 40 is fully engaged in the notch 38 with the drive arm 60*a* at its lowermost position. A raising of the drive arm 60*a* causes swing arm 56 to swing in a clockwise direction in preference to movement of the hook arm 42 under the influence of spring 61. Motion of swing arm 56 continues until hook end 40 has pushed the strike plate 28 away. At this point in time, further motion of the swing arm 56 is blocked by a stop (not shown), and upward motion of drive arm 60*a* is accommodated by rotation of hook end 40 away from the notch 38.

Referring now to FIG. 5, opposite ends of corresponding drive arms 60*a* and 60*b*, with respect to the ends connected to their corresponding hook arms 42*a* and 42*b*, are attached to a crank 64 rotating about a horizontal shaft 66 generally perpendicular to the plane of the support plate 57 as well as the planes of hook arms 42, swing arms 56 and drive arm 60*a* and 60*b* and their motion. The crank 64 provides two crank arms separated in angle by 180 degrees: an upper crank arm portion providing a pivot point 68*a* attached pivotally to the lower portion of drive arm 60*a*, and a lower crank arm portion providing a pivot point 68*b* attached to the upper end of the lower drive arm 60*b*. The crank 64 is rotated to provide the requisite up and down motion of the drive arms 60*a* and 60*b* described above, by a DC gear motor 81, as will be described further below.

Clockwise rotation of the crank 64, from a position as indicated in FIG. 5, with the pivot points 68*a* and 68*b* in vertical opposition, produces sequential cross-axial motion 48 and axial motion 50 (per FIG. 3), as pivot points 68*a* and 68*b* switch positions, with 180 degrees of rotation of the crank 64. Counterclockwise rotation of the crank 64, from this position, produces sequential axial motion 50' and cross-axial motion 48', with the crank 64 returning to the position shown in FIG. 5. Because the forces on drive arms 60*b* and 60*a* are symmetric, there is no side thrust loading of the shaft of the motor assembly 79 supporting the crank 64. Further, at the extreme rotations of the crank 64, corresponding with the door 14 being fully closed against the strike plate 28 or fully open, an axis of force along the drive arms 60*a* and 60*b* is generally aligned with lines between the pivot points 68*a* and 68*b* and the center of the shaft 66 of the gear motor 81, resulting in a minimized torque on the gear motor 81 from forces on the drive arms 60*a* and 60*b* and a maximum leverage by the gear motor 81 on the drive arms 60*a* and 60*b*.

Referring now to FIG. 6, hook end 40 of hook arm 42*b* (as shown, and similarly for hook arm 42*a*) engages a vertically-extending wall 71 on the door side of notch 38 between a horizontal wall 74 of the notch 38 and an inwardly-projecting tooth 72 so as to capture the hook end 40 between a horizontal wall 74 of the notch 38 and the inwardly-projecting tooth 72. Similarly, the hook end 40 of the hook arm 42*b* provides a horizontally-extending portion terminating in tooth 70 hooking back toward the door 14 to capture the vertically-extending wall between the body of the hook arm 42 and the tooth 70. This double hooked-engagement prevents simple bending of the strike plate 28 or the hook arms 42 out of their normal plane of motion from serving to disengage the two, thus resisting jimmying of the locking mechanism 24 by the insertion of a tool to bend these components when the hook bolts are engaged.

Referring now to FIG. 7, the strike plate 28 may include a guide notch 76 extending horizontally inward from a door facing edge of the strike plate to receive a roller 78 mounted to the support plate 57 generally perpendicular to the plane of the strike plate 28. Engagement of the guide notch 76 and roller 78 corrects sagging in the door 14 correcting the alignment of the two as the door 14 and cabinet 12 are closed. The roller 78 also resists defeating of the lock by upward or downward displacement of the door to disengage one or both hook arms 42.

A door switch 80 mounted on the support plate 57 may be triggered by a corner of the guide notch 76 to provide an indication that the door 14 and cabinet 12 are sufficiently close as to enable them to be engaged with the locking mechanism 24.

Referring again to FIGS. 5 and 7, a hole 91 in the strike plate may align with a threaded hole (not shown) in support plate 57. A screw 93 passing through the support plate 57 into hole 91 provides for a shipping lock for the assembly.

A cover 100 may fit over the lock assembly 30 to protect the motor assembly 79 and other components from tampering or damage.

Figure 8:
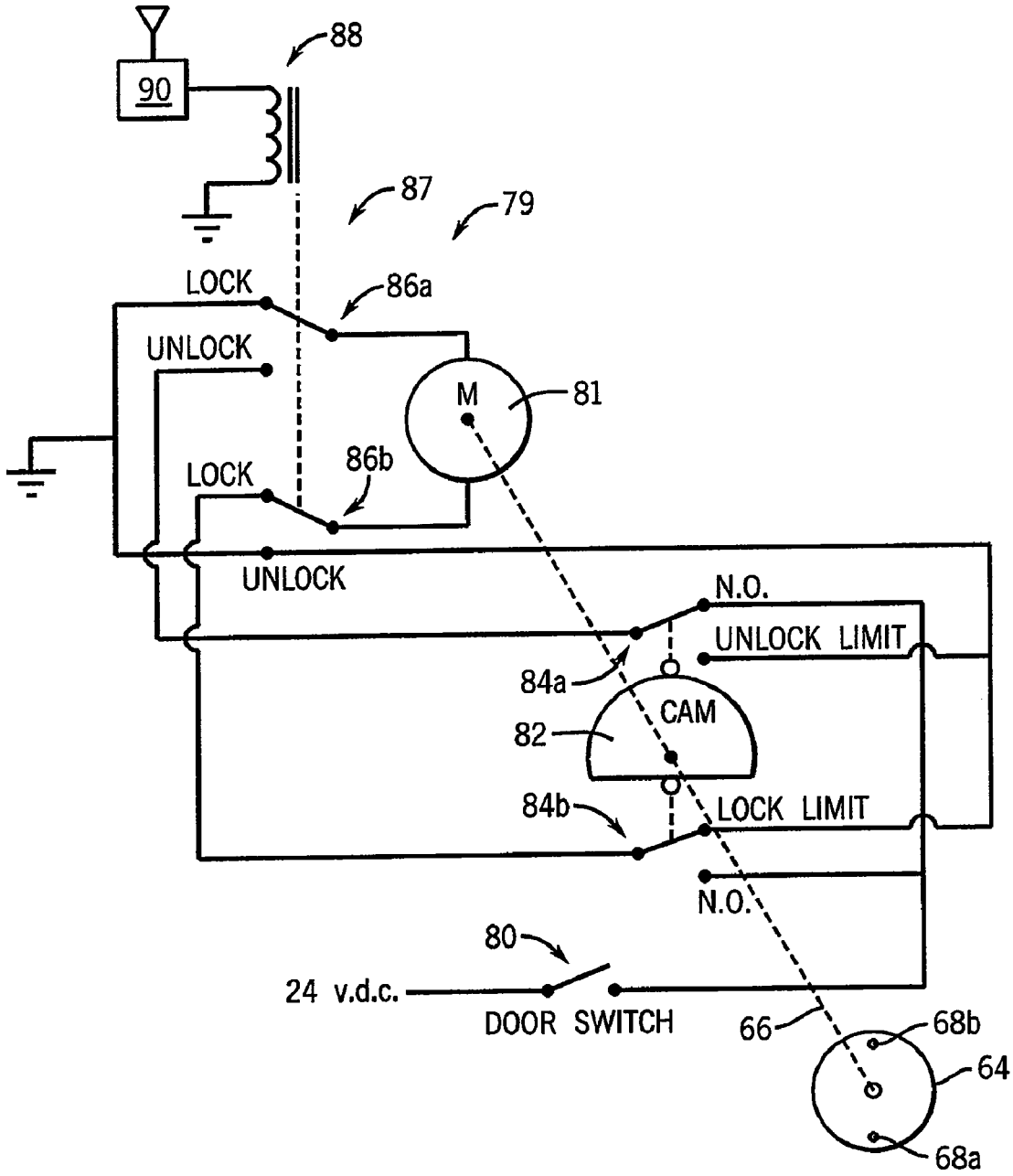
FIG. 8 is an electrical schematic showing connection of the door switch of FIG. 7 and gear motor of FIG. 5 for normal actuation.

Referring now to FIG. 8, the motor assembly 79 attached to the crank 64 to rotate it about axis 66 includes a DC gear motor 81 that also rotates a cam 82 turning equally with the crank 64. The cam 82 actuates a pair of single-pole, double-throw switches 84*a* and 84*b* as will be described.

Motor assembly 79 also incorporates a relay 87 that may control the locking and unlocking of the door through two, tandem single-pole, double-throw contact sets 86*a* and 86*b*. The relay coil 88 may be energized by a radio receiver 90, such as a Bluetooth receiver, receiving an encrypted signal to control locking or unlocking of the door. Alternatively, or in addition, the relay coil 88 may be activated by a key switch (not shown) allowing manual switching with a key or the like. In yet another embodiment, the key switch may replace the relay 87.

The poles of the double-pole switches 84 are connected to opposite terminals of the DC motor 81 that drives the cam 82 and the crank 64. Generally, the cam 82 and switches 84*a* and 84*b* serve to stop the rotation of the crank 64 in either of the two positions separated by 180 degrees as described above with pivot points 68*a* and 68*b* are vertically opposed.

When the relay 87 is in a lock position, contact set 86*a* connects one terminal of the motor 81 to ground (through its "lock" throw) while contact set 86*b* connects the other terminal of the motor 81 to the pole of switch 84*b* (also through its "lock" throw). When the door 14 is closed and locked, switch 84*b* is connected to its "lock limit" throw, which is in turn also connected to ground. Thus, both terminals of the motor 81 are grounded and there is no motion of the motor 81.

When contact set 86*a* is moved to the unlocked position, with the door 14 still in the locked state, the corresponding terminal of the motor 81 is connected to an "unlock" throw of contact set 86*a*, which leads to the pole of switch 84 (in "normally open" throw), which connects through closed door switch 80 to a source of power. The remaining terminal of motor 81 is connected through contact set 86*b*, which now connects to this terminal to ground through its "unlock" throw. These connections cause gear motor 81 to turn in an unlocking direction (counterclockwise per FIG. 5).

The motor 81 turns until cam 82 reverses the pole positions of switches 84*a* and 84*b*. This in turn causes a grounding of the unlock throw of contact set 86*a*, providing ground to both terminals of gear motor 81, causing the motor 81 to stop. The grounding of both terminals of the gear motor 81 provides a dynamic braking of the motor in which kinetic energy of the gear motor 81 is absorbed by resistive dissipation of power generated by the gear motor 81, reducing any coasting of the gear motor 81.

Door switch 80, at this time, may open as the door 14 is opened preventing further actuation of the motor 81 until the door 14 is again closed sufficiently to close the door switch 80 (generally before substantial compression of the gasket).

When the door 14 is closed, a change of state of the contact set 86, for example, by activation of the relay 87, moves the pole of contact set 86 back to the "lock" throw state connecting one terminal of gear motor 81 to ground and the second terminal of the motor 81 through contact set 86*b* and its "lock" throw, to switch 84*b* (now in the opposite state shown in FIG. 8). Switch 84 completes a connection between the terminal of the gear motor 81 to power via the door switch 80.

Assuming that the door 14 is sufficiently closed so that the locking mechanism 24 can operate, power is again provided to the motor 81, but this time in the opposite polarity as before, rotating the cam 82 to lock the door 14 until it returns to the state shown in FIG. 8 with switch 84*b* connecting the terminal of motor 81 attached to contact set 86*b* to ground, and switch 84*a* connecting the terminal of motor 81 attached to contact set 86*a* to ground. Motion of the motor 81 is again stopped with dynamic braking.

It will be understood from the above description that the relative position of the strike plate 28 and the lock assembly 30 on the door 14 and cabinet 12 may be reversed.

Figure 10:
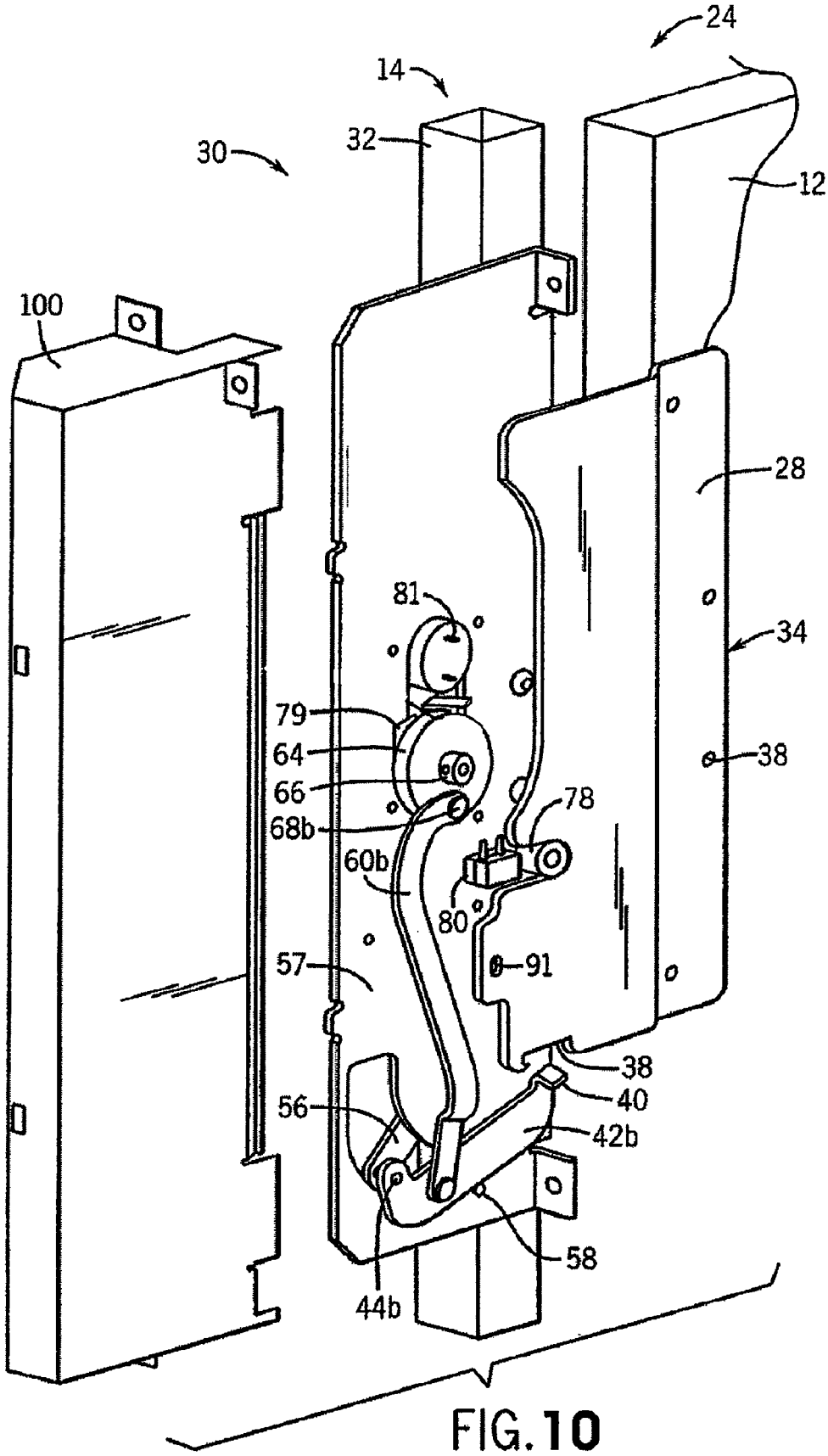
FIG. 10 is a figure identical to FIG. 5 but for the elimination of one hook bolt and its associated mechanisms and strike-plate notch.

FIG. 10 shows a version of the present invention having only one hook bolt and associated mechanism.

It is specifically intended that the present invention not be limited to the embodiments and illustrations contained herein, but include modified forms of those embodiments including portions of the embodiments and combinations of elements of different embodiments as come within the scope of the following claims.

I claim:

1. A motorized vending machine lock for a vending machine providing a cabinet housing a vending apparatus and a door attached to the cabinet to open and close the cabinet, the lock comprising:

a strike plate attached to one of a door and cabinet of the vending machine;

a bolt attached to an other of the door and cabinet;

an electric motor driving an actuator mechanism to:

(i) in a first operating mode, engage the bolt and the strike at spatially separated points, and then draw the door against the cabinet, and (ii) in a second operating mode, release the door from the cabinet, and then disengage the bolt from the strike plate wherein the bolt is a pivoting hook having a hook end movable within a plane to engage and disengage with a corresponding hook engagement point on the strike plate and movable within the plane to extend and retract along a direction of separation of the door and cabinet, wherein the actuator mechanism includes:

a frame supporting the motor;

a swing arm pivotally attached to the frame at a first end and at a second end pivotally attached to a first pivot point on the hook at a location removed from a hook portion engaging the strike plate, to allow the swing arm and hook to pivot with respect to each other through a range of acute angles;

a crank attached to the motor to provide a crank end moving with actuation of the motor; and a drive linkage pivotally attached to the crank end and pivotally attached to a second pivot point on the hook between the first pivot point and the hook portion.

2. The motorized vending machine lock of claim 1 wherein one of the door and cabinet includes a gasket extending along an edge of an interface between the door and the cabinet, and wherein the spatially separated points are separated along the gasket.

3. The motorized vending machine lock of claim 1 wherein the actuator mechanism operates in the first mode when the motor turns in a first direction and in the second mode when the motor turns in a second direction.

4. The motorized vending machine lock of claim 1 wherein the hook end and hook engagement point provide interengaging portions that when engaged surround portions of each other by substantially 180 degrees.

5. The motorized vending machine lock of claim 1 wherein the swing is substantially aligned with a direction of separation of the door and cabinet when the hook is engaged with the strike plate and the door is closed.

6. The motorized vending machine lock of claim 1 wherein the hook engages and disengages from the hook engagement point by motion about a pivot point substantially aligned with a corresponding hook engagement point along the direction of separation of the door and the cabinet.

7. The motorized vending machine lock of claim 1 further including a second swing arm pivotally attached to the frame at a first end of the second swing arm and at a second end of the second swing arm pivotally attached to a first pivot point on a second hook at a location removed from a hook portion of the second hook engaging a second strike plate to allow the second swing arms and hooks hook to pivot with respect to each other through a range of acute angles and wherein the crank provides a second crank with a second crank end moving with actuation of the motor; and a second drive linkage pivotally attached to the second crank end and pivotally attached to a second pivot points point on the second hook between the first pivot point and the hook portion of the second hook;

wherein the crank ends are substantially at 180 degree spacing about an axis of rotation of the crank, and wherein the first and second drive linkages extend symmetrically in opposite directions.

8. The motorized vending machine lock of claim 1 further including a radio link providing a signal to the motor to operate the motor in a first operating mode.

9. The motorized vending machine lock of claim 1 further including an alignment guide positioning the strike plate and bolt in alignment before engagement of the bolt with the strike plate.

10. The motorized vending machine lock of claim 1 further including a secondary lock holding the door closed for shipping.

11. The motorized vending machine lock of claim 1 further including an electric switch providing a signal indicating that the door is close enough to the cabinet for the bolt to engage the strike plate.

12. A motorized vending machine lock for a vending machine providing a cabinet housing a vending apparatus and a door attached to the cabinet to hingeably open and close the cabinet along a separation axis, the lock comprising:

a strike plate attached to one of a door and cabinet of a vending machine, the strike plate providing hook engagement points;

a motorized bolt assembly attached to the other of the door and cabinet and providing:

(i) a bolt having a hook end movable within a plane to engage and disengage with the hook engagement point and movable within the plane to extend and retract along a direction of separation of the door and cabinet; and (ii) an actuator mechanism providing a motor and operating in a first mode when the door is open to move the hook toward the strike plate with translative motion of the hook along the separation axis, engage the strike plate with translative motion of the hook across the separation axis, and pull the strike plate to close the door with translative motion of the hook along the separation axis, and in a second mode when the door is closed to move the hook with translative motion of the hook along the separation axis to open the door, disengage the strike plate with translative motion of the hook across the separation axis, and pull the hook away from the strike plate with translative motion of the hook along the separation axis wherein the actuator mechanism includes:

a frame supporting the motor;

a swing arm pivotally attached to the frame at a first end, and at a second end, pivotally attached to a first pivot point on the hook removed from a hook portion engaging the strike plate, to allow the swing arm and hook to pivot with respect to each other through a range of acute angles;

a crank attached to the motor provides a crank end moving with actuation of the motor; and a drive linkage pivotally attached to the crank end and pivotally attached to a second pivot point on the hook between the first pivot point and the hook portion.

13. The motorized vending machine lock of claim 12 wherein the actuator operates in the first mode when the motor turns in a first direction, and in the second mode when the motor turns in a second direction.

14. The motorized vending machine lock of claim 12 wherein the actuator mechanism is a set of motor actuated levers exclusively pivoting about axes perpendicular to the plane.

15. The motorized vending machine lock of claim 12 wherein the swing arm is substantially aligned with the direction of separation of the door and cabinet when the hook is engaged with the strike plate and the door is closed.

16. The motorized vending machine lock of claim 12 wherein the hook engages and disengages from the hook engagement point by motion about a pivot point substantially aligned with the hook engagement point along the direction of separation of the door and the cabinet.

17. The motorized vending machine lock of claim 12 wherein the strike has a second hook engagement point, and further including a second bolt having a hook end movable within the plane to engage and disengage with the second hook engagement point and movable within the plane to extend and retract along the direction of separation of the door and cabinet; and wherein the actuator mechanism operates in a first mode when the door is open to move the second hook toward the strike plate, engage the strike plate, and pull the strike plate to close the door, and in a second mode when the door is closed to move the hook to open the door, disengage the strike plate, and pull the hook away from the strike plate.

18. The motorized vending machine lock of claim 17 wherein the crank provides a second crank end, and wherein the actuator mechanism further includes:

a second swing arm pivotally attached to the frame at a first end and at a second end pivotally attached to a first pivot point on a second hook removed from a hook portion engaging the strike plate to allow the second swing arm and second hook to pivot with respect to each other through a range of acute angles; and a second drive linkage pivotally attached to the second crank end, and pivotally attached to a second pivot point on the second hook between the first pivot point and the hook portion.

19. The motorized vending machine lock of claim 18 wherein the first crank end and second crank end are substantially at 180 degree spacing about an axis of rotation of the crank, and wherein the drive linkage and second drive linkage end symmetrically in opposite directions.

20. The motorized vending machine lock of claim 12 wherein the hook end and hook engagement point provide interengaging portions that, when engaged, surround portions of each other by substantially 180 degrees.

21. The motorized vending machine lock of claim 12 further including a dynamic braking circuit attached to motor to dynamically brake the motor when the motor is not being energized.

22. The motorized vending machine lock of claim 12 wherein the actuator mechanism includes:

a frame supporting the motor;

a crank attached to the motor providing a crank end moving about a shaft with actuation of the motor; and a drive linkage pivotally attached to the crank to provide a force along a force axis to activate the bolt;

wherein a line between the pivotal attachment of the crank to the drive linkage and the shaft is substantially aligned with the force axis when the strike plate is pulled against the door.

* * * * *